US011105260B2

(12) United States Patent
Takeda et al.

(10) Patent No.: US 11,105,260 B2
(45) Date of Patent: Aug. 31, 2021

(54) OUTBOARD MOTOR AND SHIFT SWITCH OF OUTBOARD MOTOR

(71) Applicant: YAMAHA HATSUDOKI KABUSHIKI KAISHA, Iwata (JP)

(72) Inventors: Yukio Takeda, Shizuoka (JP); Yuki Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 335 days.

(21) Appl. No.: 16/205,266

(22) Filed: Nov. 30, 2018

(65) Prior Publication Data

US 2019/0218966 A1 Jul. 18, 2019

(30) Foreign Application Priority Data

Jan. 12, 2018 (JP) ..... JP2018-003368

(51) Int. Cl.

| | |
|---|---|
| ***F02B 61/04*** | (2006.01) |
| ***B63H 20/14*** | (2006.01) |
| ***F01M 11/00*** | (2006.01) |
| ***B63H 20/32*** | (2006.01) |
| ***B63H 20/00*** | (2006.01) |
| ***F01M 11/02*** | (2006.01) |

(52) U.S. Cl.

CPC ..... *F02B 61/045* (2013.01); *B63H 20/001* (2013.01); *B63H 20/14* (2013.01); *B63H 20/32* (2013.01); *F01M 11/0004* (2013.01); *F01M 11/02* (2013.01)

(58) Field of Classification Search

CPC ..... F02B 61/045; B63H 20/001; B63H 20/14; B63H 20/32

See application file for complete search history.

(56) References Cited

U.S. PATENT DOCUMENTS

| | | | | |
|---|---|---|---|---|
| 9,475,562 | B2 * | 10/2016 | Sugiyama | B63H 23/16 |
| 9,896,177 | B1 * | 2/2018 | Tuchscherer | F16H 63/304 |
| 2003/0224672 | A1 * | 12/2003 | Takada | B63H 20/20 440/75 |
| 2007/0287340 | A1 * | 12/2007 | Oguma | B63H 20/00 440/75 |
| 2010/0250036 | A1 * | 9/2010 | Bamba | F02D 25/00 701/21 |
| 2010/0256844 | A1 * | 10/2010 | Ito | B63H 21/22 701/21 |
| 2016/0288892 | A1 * | 10/2016 | Ooshita | B63H 20/20 |
| 2017/0137102 | A1 | 5/2017 | Hamada et al. | |
| 2017/0349256 | A1 * | 12/2017 | Nakamura | B63H 20/20 |

(Continued)

FOREIGN PATENT DOCUMENTS

| | | | |
|---|---|---|---|
| JP | 2004-001638 | A | 1/2004 |
| JP | 2004-245349 | A | 9/2004 |
| JP | 2006-117111 | A | 5/2006 |

(Continued)

*Primary Examiner* — S. Joseph Morano
*Assistant Examiner* — Jovon E Hayes
(74) *Attorney, Agent, or Firm* — Keating & Bennett, LLP

(57) ABSTRACT

An outboard motor includes a shift switch including a shift shaft and a rotary drive provided on an axis of the shift shaft and that rotates the shift shaft, and that switches a rotation direction of a propeller shaft. An entirety of the rotary drive is disposed below a mount, and at least a portion of the rotary drive is disposed above a lower case.

25 Claims, 7 Drawing Sheets

(56) References Cited

U.S. PATENT DOCUMENTS

2019/0218966 A1* 7/2019 Takeda ..... B63H 20/001

FOREIGN PATENT DOCUMENTS

| | | | |
|---|---|---|---|
| JP | 2007-331483 | A | 12/2007 |
| JP | 2016-196249 | A | 11/2016 |
| JP | 2017-088040 | A | 5/2017 |
| JP | 2017-218016 | A | 12/2017 |

* cited by examiner

DURING NEUTRAL

DURING FORWARD TRAVELING

DURING REARWARD TRAVELING

OUTBOARD MOTOR AND SHIFT SWITCH OF OUTBOARD MOTOR

CROSS REFERENCE TO RELATED APPLICATIONS

This application claims the benefit of priority to Japanese Patent Application No. 2018-003368 filed on Jan. 12, 2018. The entire contents of this application are hereby incorporated herein by reference.

BACKGROUND OF THE INVENTION

1. Field of the Invention

The present invention relates to an outboard motor including a shift switch and a shift switch of an outboard motor.

2. Description of the Related Art

An outboard motor including a shift switch is known in general. Such an outboard motor including a shift switch is disclosed in Japanese Patent Laid-Open No. 2016-196249, for example.

Japanese Patent Laid-Open No. 2016-196249 discloses an outboard motor including a shift actuator (shift switch) that switches a shift (rotation direction) by switching a gear of a propeller shaft. The shift actuator of the outboard motor includes an electric motor (rotary drive), a screw shaft that rotates about an axis different from the axis of the electric motor due to a rotational drive force transmitted from the electric motor via a gear mechanism, and a movable nut that moves in an upward-downward direction due to the rotation of the screw shaft. The propeller shaft is connected to the movable nut, and the gear is switched due to the upward and downward movement of the movable nut.

However, in the shift actuator of the outboard motor disclosed in Japanese Patent Laid-Open No. 2016-196249, it is necessary to transmit a drive force to the rotation shaft located on the axis different from the axis of the electric motor using the gear mechanism in order to switch a shift such that the number of components increases, and the size of the shift actuator is increased due to the gear mechanism.

SUMMARY OF THE INVENTION

Preferred embodiments of the present invention provide shift switches, and outboard motors including the shift switches, in each of which an increase in the number of components and an increase in the sizes of the shift switches or the outboard motors are significantly reduced or prevented.

An outboard motor according to a preferred embodiment of the present invention includes an engine, a propeller, a propeller shaft that transmits a drive force from the engine to the propeller, a mount that dampens a vibration of the engine transmitted to a vessel body, an upper case to which the mount is attached, a lower case disposed below the upper case and in which the propeller shaft is disposed, and a shift switch including a shift shaft that extends in an upward-downward direction and rotates to move the propeller shaft in a direction in which the propeller shaft extends and a rotary drive provided on an axis of the shift shaft and that rotates the shift shaft, and that switches a rotation direction of the propeller shaft. An entirety of the rotary drive is disposed below the mount, and at least a portion of the rotary drive is disposed above the lower case.

In an outboard motor according to a preferred embodiment of the present invention, the rotary drive is provided on the axis of the shift shaft. Accordingly, a drive force is directly transmitted from the rotary drive to the shift shaft in order to rotate the shift shaft, and thus it is not necessary to provide an axis at a position different from that of the rotary drive. Consequently, it is not necessary to provide a different axis, and thus an increase in the number of components of the shift switch that switches the rotation direction of the propeller shaft and an increase in the size of the shift switch are significantly reduced or prevented. Therefore, an increase in the number of components of the outboard motor including the shift switch and an increase in the size of the outboard motor are significantly reduced or prevented.

In an outboard motor according to a preferred embodiment of the present invention, the entirety of the rotary drive is disposed below the mount attached to the upper case. Accordingly, as compared with the case in which at least a portion of the rotary drive is disposed above the mount, it is not necessary to extend the shift shaft to the height of the mount in the upward-downward direction, and thus an increase in the size of the shift switch is further significantly reduced or prevented. In addition, the lower case, the substantially entire portion of which is located under the water surface during traveling of a marine vessel on which the outboard motor is attached, is preferably downsized in order to significantly reduce or prevent an increase in resistance (wave-making resistance) generated during traveling. Therefore, in a preferred embodiment of the present invention, at least the portion of the rotary drive is disposed above the lower case such that an increase in the size of the lower case is significantly reduced or prevented, and thus an increase in resistance generated during traveling is significantly reduced or prevented.

In an outboard motor according to a preferred embodiment of the present invention, the rotary drive is preferably disposed adjacent to or in a vicinity of an upper end of the lower case. Accordingly, the shift shaft is disposed adjacent to or in the vicinity of the upper end of the lower case, and increases in the sizes of the shift switch and the outboard motor are further significantly reduced or prevented.

An outboard motor according to a preferred embodiment of the present invention preferably further includes a steering shaft that extends in the upward-downward direction and allows the outboard motor to turn, and the entirety of the rotary drive is preferably disposed below the steering shaft. Accordingly, as compared with the case in which at least a portion of the rotary drive is disposed above the steering shaft, it is not necessary to extend the shift shaft to the height of the steering shaft in the upward-downward direction, and thus an increase in the size of the shift switch is further significantly reduced or prevented. Furthermore, the rotary drive is disposed directly below the steering shaft, and thus as compared with the case in which the steering shaft and the rotary drive are displaced from each other in a horizontal plane perpendicular to the upward-downward direction, an increase in the size of the outboard motor in a horizontal direction is significantly reduced or prevented. Thus, an increase in resistance generated during traveling due to an increase in the size of the outboard motor in the horizontal direction is significantly reduced or prevented.

In an outboard motor according to a preferred embodiment of the present invention, the shift switch preferably further includes a rotation sensor provided on the axis of the shift shaft and that detects rotation of the shift shaft. Accordingly, the rotation sensor is disposed on the axis of the shift shaft that extends in the upward-downward direction, and thus as compared with the case in which the shift shaft and the rotation sensor are displaced from each other in the horizontal plane perpendicular to the upward-downward direction, an increase in the size of the shift switch in the horizontal direction is significantly reduced or prevented. Consequently, an increase in resistance generated during traveling due to an increase in the size of the outboard motor in the horizontal direction is significantly reduced or prevented. Furthermore, rotation of the shift shaft is detected by the rotation sensor such that the rotation direction (shift state) of the propeller shaft is determined.

In this case, an entirety of the rotation sensor is preferably disposed below the mount and above the lower case. Accordingly, as compared with the case in which at least a portion of the rotation sensor is disposed above the mount, it is not necessary to extend the shift shaft to the height of the mount in the upward-downward direction in order for the rotation sensor to detect the rotation, and thus an increase in the size of the shift switch is further significantly reduced or prevented. Furthermore, the entirety of the rotation sensor is disposed above the lower case such that an increase in the size of the lower case is significantly reduced or prevented, and thus an increase in resistance generated during traveling is significantly reduced or prevented.

When the shift switch includes the rotation sensor, an entirety of the rotation sensor is preferably disposed below the mount and above the rotary drive. Accordingly, as compared with the case in which the rotation sensor is disposed below the rotary drive, the length of the shift shaft in the upward-downward direction connected to the rotary drive is reduced.

In this case, an outboard motor according to a preferred embodiment of the present invention preferably further includes a first cover that covers an upper portion of the rotary drive, and the rotation sensor is preferably attached to an upper surface of the first cover. Accordingly, the rotation sensor is easily fixed above the rotary drive and adjacent to or in the vicinity of the rotary drive.

When the shift switch includes the rotation sensor, the rotation sensor preferably includes a rotation detected element fixed to the shift shaft and that rotates together with the shift shaft. Accordingly, rotation of the shift shaft is directly detected, and thus rotation of the shift shaft is more accurately detected.

When the shift switch includes the rotation sensor, an outboard motor according to a preferred embodiment of the present invention preferably further includes a steering shaft that extends in the upward-downward direction and allows the outboard motor to turn, and an entirety of the rotation sensor is preferably disposed below the steering shaft. Accordingly, as compared with the case in which at least a portion of the rotation sensor is disposed above the steering shaft, an increase in the size of the shift switch is further significantly reduced or prevented. In addition, the rotation sensor is disposed directly below the steering shaft, and thus as compared with the case in which the steering shaft and the rotation sensor are displaced from each other in the horizontal plane perpendicular to the upward-downward direction, an increase in the size of the outboard motor in the horizontal direction is significantly reduced or prevented.

When the shift switch includes the rotation sensor, the lower case preferably includes an oil chamber that extends in the upward-downward direction and in which the shift shaft and oil are located, and an entirety of the rotation sensor is preferably located above the oil chamber. Accordingly, an increase in the temperature of the rotation sensor due to the heat of the oil in the oil chamber transmitted to the rotation sensor is significantly reduced or prevented. Furthermore, the rotation sensor and the oil chamber are not located at the same height in the upward-downward direction, and thus it is not necessary to increase the size of the lower case in order to preserve the volume of an air pocket in the oil chamber. Furthermore, a decrease in the volume of the oil chamber is significantly reduced or prevented.

In an outboard motor according to a preferred embodiment of the present invention, the rotary drive and the shift shaft are preferably integrally detachable. Accordingly, the process to detach the rotary drive and the shift shaft from the outboard motor is simplified, and thus the rotary drive and the shift shaft are easily replaced, for example.

In an outboard motor according to a preferred embodiment of the present invention, the mount is preferably disposed below the center of the upper case in the upward-downward direction. In this case, the entirety of the rotary drive is disposed below the mount attached to the upper case such that an increase in the size of the shift switch is more reliably significantly reduced or prevented.

An outboard motor according to a preferred embodiment of the present invention preferably further include a water pump disposed above the lower case and that supplies external water to the engine, and the rotary drive is preferably disposed adjacent to or in a vicinity of the water pump. Accordingly, a portion of the water that flows from the water pump to the engine is supplied to the periphery of the rotary drive, and thus the rotary drive is cooled by the water. Consequently, an increase in the temperature of the rotary drive is significantly reduced or prevented.

In this case, the rotary drive and the water pump are preferably disposed side by side in a forward-rearward direction of the vessel body in a state in which the outboard motor is attached to the vessel body. The term "a state in which the outboard motor is attached to the vessel body" indicates a state in which a direction in which the axis of the propeller shaft extends coincides with the forward-rearward direction of the vessel body. Accordingly, as compared with the case in which the rotary drive and the water pump are displaced from each other in a direction different from the forward-rearward direction in the horizontal plane, an increase in the size of the outboard motor in a direction perpendicular to the forward-rearward direction in the horizontal plane is significantly reduced or prevented. Thus, an increase in the size of the outboard motor in a direction perpendicular to the traveling direction of the vessel body to which the outboard motor is attached is significantly reduced or prevented, and thus an increase in resistance generated during traveling is significantly reduced or prevented.

An outboard motor according to a preferred embodiment of the present invention preferably further includes a first cover that covers an upper portion of the rotary drive and a second cover disposed at an upper end of the lower case so as to correspond to the first cover and that covers the rotary drive from below, and the rotary drive is preferably disposed in a housing space defined by the first cover and the second cover. Accordingly, at least a portion of the rotary drive is easily disposed above the lower case while the rotary drive is protected by the first cover and the second cover. Furthermore, as compared with the case in which the first cover and the second cover are integral and unitary with each other, the rotary drive is more easily disposed in the housing space.

An outboard motor according to a preferred embodiment of the present invention preferably further includes a first cover that covers an upper portion of the rotary drive and covers the rotary drive from below, and the rotary drive is preferably disposed in a housing space defined by the first cover. Accordingly, at least a portion of the rotary drive is easily disposed above the lower case while the rotary drive is protected by the first cover. Furthermore, as compared with the case in which the first cover includes a plurality of covers, an increase in the number of components is significantly reduced or prevented.

In an outboard motor according to a preferred embodiment of the present invention, the lower case preferably includes an oil chamber that extends in the upward-downward direction and in which the shift shaft and oil are located, and at least a portion of the rotary drive is preferably located above the oil chamber. Accordingly, at least the portion of the rotary drive and the oil chamber are not located at the same height in the upward-downward direction such that it is not necessary to increase the size of the lower case in order to preserve the volume of an air pocket in the oil chamber, and a decrease in the volume of the oil chamber is significantly reduced or prevented.

In an outboard motor according to a preferred embodiment of the present invention, the rotary drive preferably straddles an upper end of the lower case in the upward-downward direction. Accordingly, a portion of the rotary drive is disposed above the lower case such that an increase in the size of the lower case is significantly reduced or prevented. Furthermore, a portion of the rotary drive is disposed below the lower case such that interference between a member (such as the steering shaft) disposed above the rotary drive and the shift switch due to the rotary drive being disposed on the upper side is significantly reduced or prevented.

In an outboard motor according to a preferred embodiment of the present invention, the rotary drive is preferably an electric motor. Accordingly, unlike the case in which the shift shaft is rotated using a mechanical rotary drive to which a drive force is mechanically transmitted from the engine, the rotary drive is rotated based on an electric signal, and thus the rotation direction of the propeller shaft is easily changed by a motor controller that transmits an electric signal, for example.

In this case, an outboard motor according to a preferred embodiment of the present invention preferably further includes wiring extending from an upper portion of the electric motor. Accordingly, a motor controller, which is likely to be disposed in an upper portion of the outboard motor in order to be protected from water, for example, and the electric motor are easily electrically connected to each other.

In an outboard motor according to a preferred embodiment of the present invention, an upper end of the shift shaft is preferably disposed above an upper end of the lower case. Accordingly, the shift shaft is reliably connected to even the portion of the rotary drive disposed above the upper end of the lower case.

In an outboard motor according to a preferred embodiment of the present invention, the shift shaft and the rotary drive are preferably disposed on a side of a drive shaft, which transmits a drive force from the engine to the propeller shaft, opposite to the propeller. Accordingly, the shift shaft is generally smaller than the drive shaft, and thus an increase in the size of a portion of the lower case on the side opposite to the propeller in the horizontal direction is significantly reduced or prevented as compared with the case in which the shift shaft is disposed between the drive shaft and the propeller. Consequently, an increase in resistance (wave-making resistance) generated during traveling of the marine vessel to which the outboard motor is attached is significantly reduced or prevented.

A shift switch of an outboard motor according to a preferred embodiment of the present invention is a shift switch of an outboard motor that switches a rotation direction of a propeller shaft that transmits a drive force from an engine to a propeller, and includes a shift shaft that extends in an upward-downward direction and rotates to move the propeller shaft in a direction in which the propeller shaft extends, and a rotary drive provided on an axis of the shift shaft and that rotates the shift shaft. An entirety of the rotary drive is disposed below a mount that dampens a vibration of the engine transmitted to a vessel body, and at least a portion of the rotary drive is disposed above a lower case in which the propeller shaft is disposed.

In a shift switch of an outboard motor according to a preferred embodiment of the present invention, the rotary drive is provided on the axis of the shift shaft, as described above. Accordingly, an increase in the number of components of the shift switch and an increase in the size of the shift switch are significantly reduced or prevented. Furthermore, the entirety of the rotary drive is disposed below the mount attached to the upper case such that an increase in the size of the shift switch is further significantly reduced or prevented. In addition, at least the portion of the rotary drive is disposed above the lower case such that an increase in the size of the lower case is significantly reduced or prevented.

In a shift switch of an outboard motor according to a preferred embodiment of the present invention, the rotary drive is preferably disposed adjacent to or in a vicinity of an upper end of the lower case. Accordingly, the shift shaft is disposed adjacent to or in the vicinity of the upper end of the lower case, and an increase in the size of the shift switch is further significantly reduced or prevented.

A shift switch of an outboard motor according to a preferred embodiment of the present invention preferably further includes a rotation sensor provided on the axis of the shift shaft and that detects rotation of the shift shaft. Accordingly, the rotation sensor is disposed on the axis of the shift shaft that extends in the upward-downward direction, and thus an increase in the size of the shift switch in a horizontal direction is significantly reduced or prevented. Furthermore, rotation of the shift shaft is detected by the rotation sensor such that the rotation direction (shift state) of the propeller shaft is determined.

In a shift switch of an outboard motor according to a preferred embodiment of the present invention, the rotary drive is preferably disposed adjacent to or in a vicinity of a water pump disposed above the lower case and that supplies external water to the engine due to a drive force of a drive shaft that transmits a drive force from the engine to the propeller shaft. Accordingly, a portion of the water that flows from the water pump to the engine is supplied to the rotary drive, and thus the rotary drive is cooled by the water. Consequently, an increase in the temperature of the rotary drive is significantly reduced or prevented.

The above and other elements, features, steps, characteristics and advantages of preferred embodiments of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of an outboard motor 100 according to preferred embodiments of the present invention is now described with reference to FIGS. 1 to 7.

Figure 1:
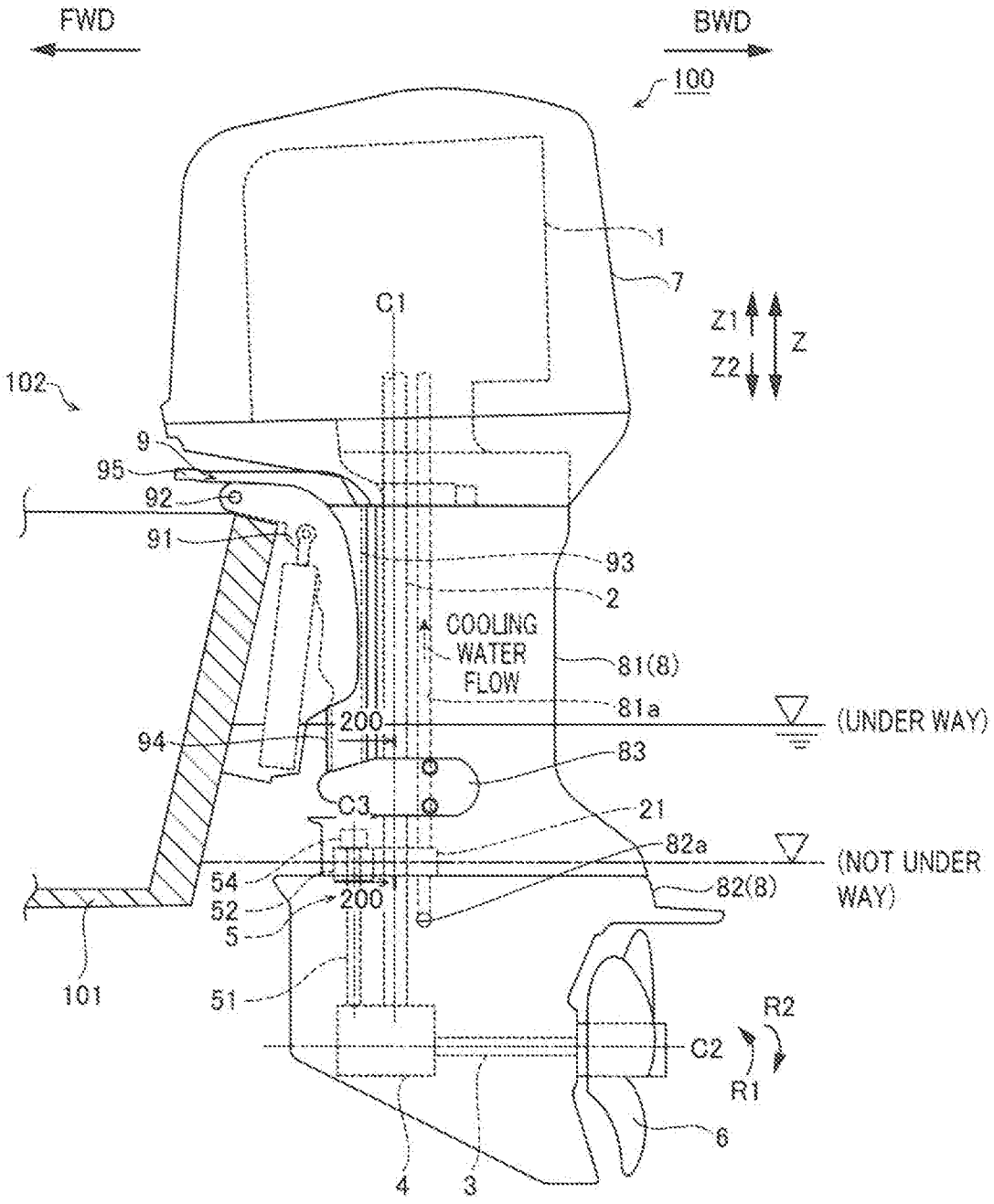
FIG. 1 is a schematic side view showing the overall structure of an outboard motor according to a preferred embodiment of the present invention.

As shown in FIG. 1, the outboard motor 100 is attached to a portion (rear portion) of a vessel body 101 in a direction BWD, for example. A marine vessel 102 includes the outboard motor 100 and the vessel body 101.

In the following description, the term "front (front portion)" represents a forward traveling direction (a direction FWD in the figures) of the marine vessel 102, and the term "rear (rear portion)" represents a direction BWD in the figures. The term "forward-rearward direction" represents the forward-rearward direction of the marine vessel 102 (outboard motor 100), and represents a direction parallel or substantially parallel to a propeller shaft 3 described below, for example. A vertical direction represents the trim/tilt direction of the outboard motor 100 and a direction Z in the figures, an upward direction corresponds to an arrow Z1 direction, and a downward direction corresponds to an arrow Z2 direction. A right-left direction represents a direction perpendicular or substantially perpendicular to the vertical direction and perpendicular or substantially perpendicular to the forward-rearward direction. A horizontal direction represents a direction along a horizontal plane perpendicular or substantially perpendicular to the vertical direction, and represents a steering direction. Hereinafter, the forward-rearward direction of the outboard motor 100 indicates a direction in which an axis C2 of the propeller shaft 3 extends when the direction in which the axis C2 of the propeller shaft 3 extends coincides with the forward-rearward direction of the vessel body 101.

The outboard motor 100 includes a water-cooled engine 1, a drive shaft 2 connected to the engine 1 and that extends in the upward-downward direction, the propeller shaft 3, a gear 4 connected to the drive shaft 2 and the propeller shaft 3, a shift switch 5 connected to the gear 4, and a propeller 6. The drive shaft 2 rotates about an axis C1 that extends in the upward-downward direction due to a rotational drive force from the engine 1. The propeller shaft 3 rotates about the axis C2 that extends in the forward-rearward direction due to the rotational drive force transmitted from the drive shaft 2 via the gear 4. The propeller 6 is attached to the rear end of the propeller shaft 3, and rotates together with the propeller shaft 3 about the axis C2.

The outboard motor 100 includes a cowling 7 in which the engine 1 is housed, a case 8, and a bracket 9.

The bracket 9 includes a crank 91 fixed to the vessel body 101 and a tilt shaft 92 that rotates the outboard motor 100 in the trim/tilt direction based on a user's tilting operation. The bracket 9 includes a steering shaft 93, a steering bracket 94 that covers the steering shaft 93, and a steering operator 95 operated by the user. The steering shaft 93 allows the outboard motor 100 to rotate (turn) in the horizontal direction (steering direction) based on a user's steering operation. The steering shaft 93 extends in the upward-downward direction.

The case 8 includes an upper case 81 and a lower case 82. The lower case 82 is disposed below the water surface when the marine vessel 102 is under way and not under way.

Figure 2:
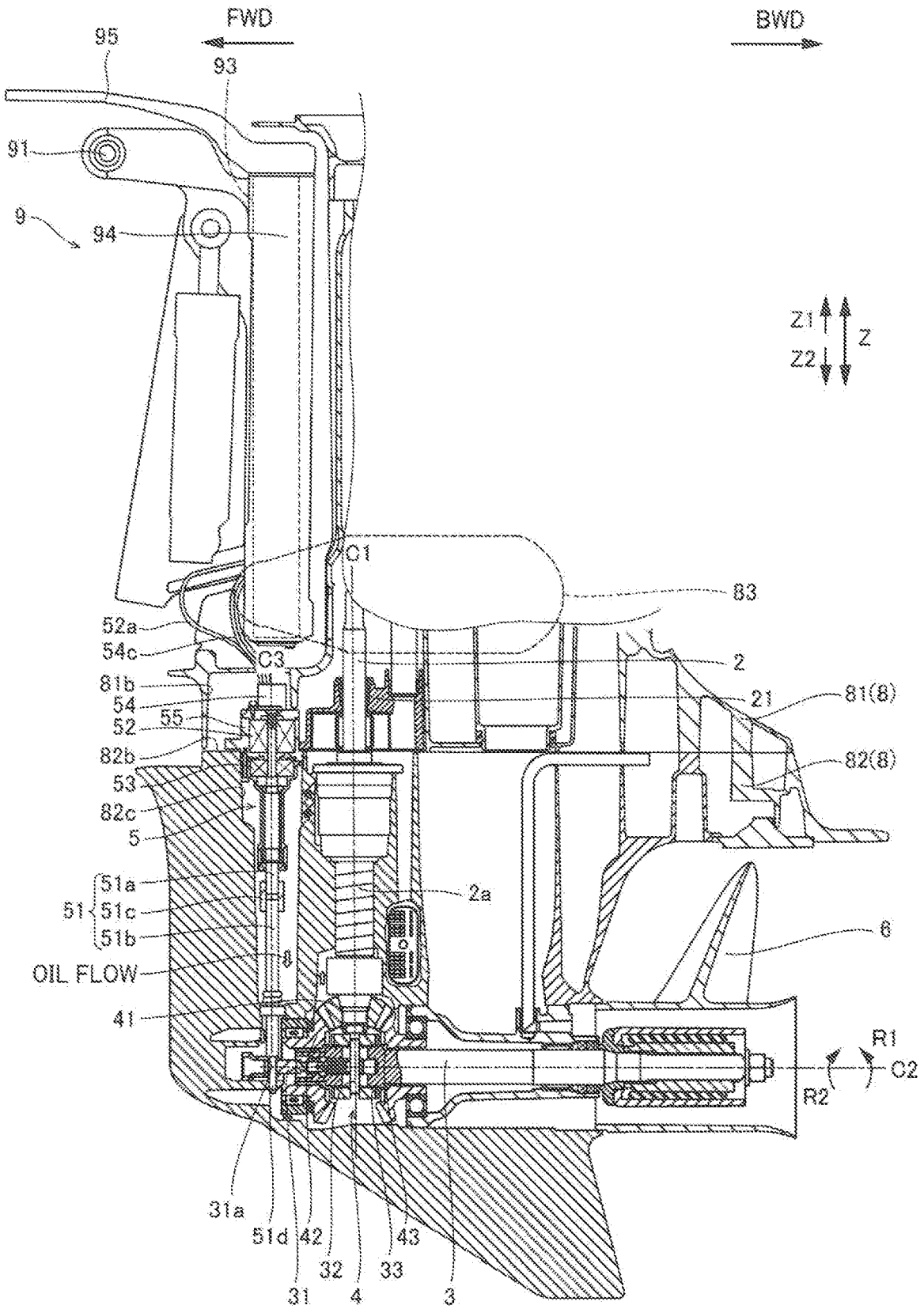
FIG. 2 is a sectional view showing the structure of an outboard motor according to a preferred embodiment of the present invention.

The drive shaft 2 passes through the upper case 81 in the upward-downward direction. The upper case 81 includes a cooling water passage 81*a* through which water (seawater in the case of sea) taken from the outside of the outboard motor 100 is supplied as cooling water to the engine 1. As shown in FIG. 2, a front space 81*b* is provided in a lower portion of the upper case 81 and below the steering shaft 93.

The steering shaft 93 is attached to the front of the upper case 81. The steering shaft 93 is connected to a pair of mounts 83 provided in the upper case 81 via the steering bracket 94. The pair of mounts 83 are respectively disposed adjacent to or in the vicinity of both side surfaces of the upper case 81 in the right-left direction, and are disposed at the same or substantially the same height in the upward-downward direction.

Figure 3:
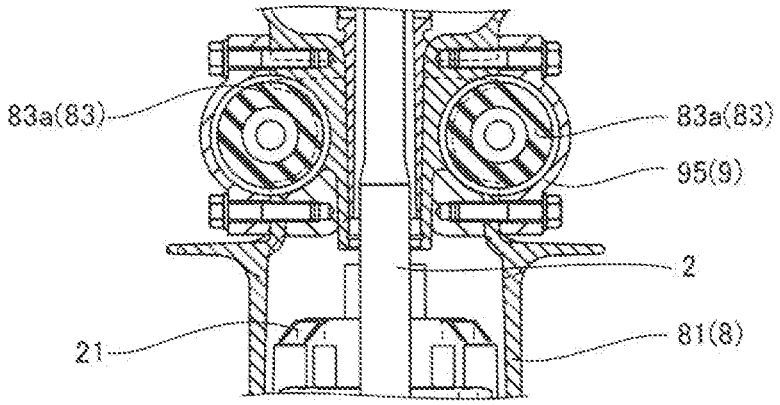
FIG. 3 is a sectional view taken along the line 200-200 in FIG. 1.

As shown in FIG. 3, the mounts 83 each include a buffer 83*a* that dampens the vibrations of the engine 1 of the outboard motor 100 transmitted to the vessel body 101. The buffer 83*a* includes a member that absorbs vibrations such as rubber, and is disposed between the steering bracket 94 and the upper case 81. Thus, the vibrations transmitted from the engine 1 to the upper case 81 are absorbed by the buffer 83*a* such that transmission of the vibrations to the vessel body 101 is significantly reduced or prevented.

As shown in FIG. 1, the lower case 82 is disposed below the upper case 81, and the propeller shaft 3 is disposed in the lower case 82. The lower case 82 includes an intake port 82*a* through which water is taken from the outside of the outboard motor 100.

Figure 4:
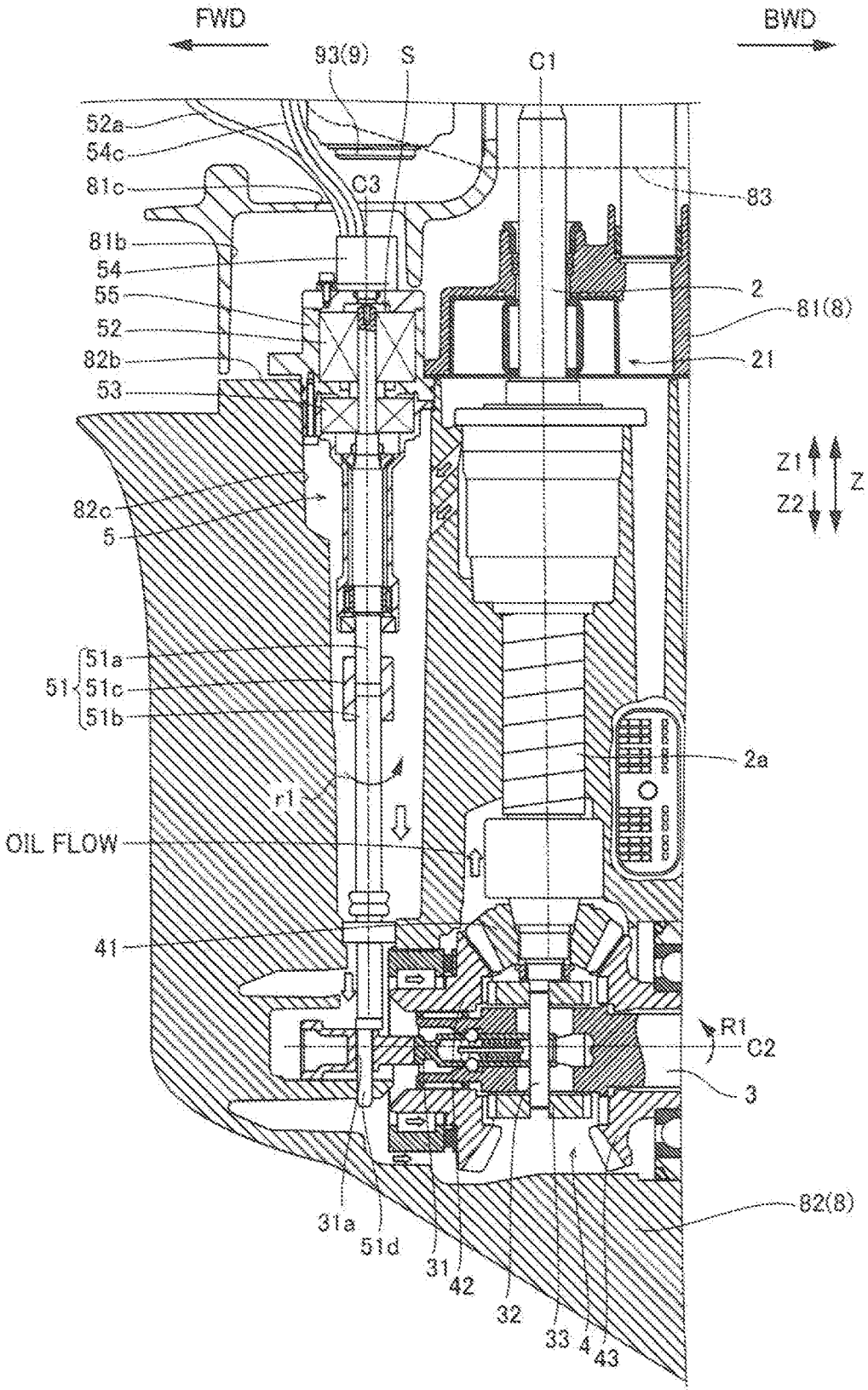
FIG. 4 is an enlarged sectional view showing the states of a shift switch, a gear, and their surroundings of an outboard motor according to a preferred embodiment of the present invention during forward traveling.
Figure 5:
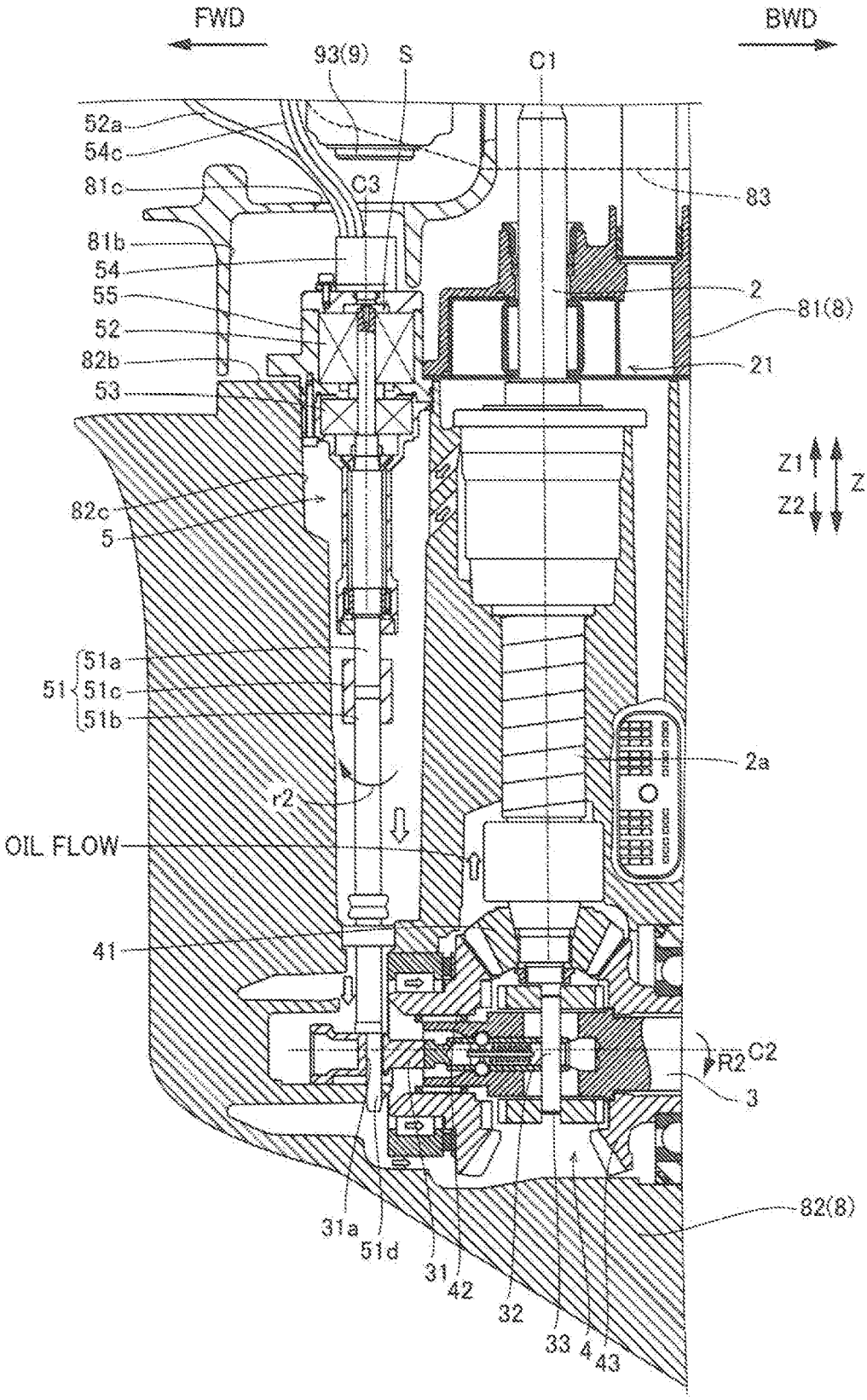
FIG. 5 is an enlarged sectional view showing the states of a shift switch, a gear, and their surroundings of an outboard motor according to a preferred embodiment of the present invention during rearward traveling.

As shown in FIGS. 2, 4, and 5, an oil groove 2*a* is provided in a portion of the drive shaft 2 disposed in the lower case 82. The oil groove 2*a* rotates about the axis C1 of the drive shaft 2 to draw oil from the gear 4.

A water pump 21 is disposed at a portion of the drive shaft 2 above the upper end 82*b* of the lower case 82 and adjacent to or in the vicinity of the lower end of the upper case 81. As shown in FIG. 1, the water pump 21 supplies the water taken through the intake port 82*a* to the water-cooled engine 1 via the cooling water passage 81*a* using the rotational drive force of the drive shaft 2. As shown in FIGS. 2, 4, and 5, the water pump 21 supplies a portion of the water that flows through the cooling water passage 81*a* into the front space 81*b* of the upper case 81.

The propeller shaft 3 is disposed in a lower portion of the lower case 82. The gear 4 is housed in a lower front portion of the lower case 82.

The gear 4 includes a bevel gear 41 attached to the lower end of the drive shaft 2, and a front bevel gear 42 and a rear bevel gear 43, both of which mesh with the bevel gear 41 and surround the propeller shaft 3. The bevel gear 41 rotates about the axis C1 together with the drive shaft 2. The front bevel gear 42 meshes with the bevel gear 41 and rotates in a direction R1 about the axis C2 of the propeller shaft 3. The rear bevel gear 43 meshes with the bevel gear 41 and rotates in a direction R2 opposite to the direction R1 about the axis C2 of the propeller shaft 3.

The propeller shaft 3 includes a slider 31 located on the front side and slidable in the forward-rearward direction in which the propeller shaft 3 extends, a connector 32 that extends in the upward-downward direction perpendicular to the slider 31, and a dog clutch 33 located at both ends of the connector in the upward-downward direction. The connector 32 and the dog clutch 33 move in the forward-rearward direction with the sliding movement of the slider 31.

An insertion hole 31*a* into which an eccentric portion 51*d* located at the lower end of a shift shaft 51 of the shift switch 5 is inserted is provided in a front portion of the slider 31. As the shift shaft 51 rotates, the position of the eccentric portion 51*d* changes in the forward-rearward direction such that the slider 31 slides in the forward-rearward direction.

The dog clutch 33 engages with the front bevel gear 42 when moving forward (arrow FWD direction), and engages with the rear bevel gear 43 when moving rearward (arrow BWD direction). Thus, when the slider 31 moves forward, as shown in FIG. 4, rotation in the direction R1 is transmitted from the front bevel gear 42 to the dog clutch 33 such that the propeller shaft 3 and the propeller 6 rotate in the direction R1. When the slider 31 moves rearward, as shown in FIG. 5, rotation in the direction R2 is transmitted from the rear bevel gear 43 to the dog clutch 33 such that the propeller shaft 3 and the propeller 6 rotate in the direction R2.

As shown in FIG. 2, the slider 31 is movable to a position at which both the front bevel gear 42 and the rear bevel gear 43 do not mesh with the dog clutch 33. At this time, the drive force from the drive shaft 2 is not transmitted to the propeller shaft 3. Consequently, the shift switch 5 switches the gear 4 such that the rotation direction of the propeller shaft 3 switches or the propeller shaft 3 stops rotating. Thus, the vessel body 101 is switched to one of forward traveling, rearward traveling, and neutral.

As shown in FIGS. 4 and 5, the shift switch 5 includes the shift shaft 51, an electric motor 52 that rotates the shift shaft 51, a speed reducer 53 that decelerates rotation of the motor 52, and a shift position sensor (SPS) 54 that detects rotation of the shift shaft 51. The motor 52 and the SPS 54 are examples of a "rotary drive" and a "rotation sensor", respectively.

The shift shaft 51 extends in the upward-downward direction and is disposed inside the lower case 82. The upper end 51*e* (see FIG. 6) of the shift shaft 51 is disposed in the front space 81*b* of the upper case 81 above the upper end 82*b* of the lower case 82.

The shift shaft 51 includes an upper portion 51*a* on the upper side, a lower portion 51*b* on the lower side, and a connector 51*c* that connects the upper portion 51*a* to the lower portion 51*b*. The eccentric portion 51*d* is located at the lower end of the lower portion 51*b* of the shift shaft 51. The eccentric portion 51*d* is displaced in the horizontal plane from the axis C3 about which the shift shaft 51 rotates. Thus, when the shift shaft 51 rotates about the axis C3, the position of the eccentric portion 51*d* changes in the forward-rearward direction such that the slider 31 slides in the forward-rearward direction.

The motor 52 generates a rotational drive force about the axis C3 based on a signal from an ECU (Engine Control Unit) (not shown) of the engine 1 disposed above the motor 52.

Figure 6:
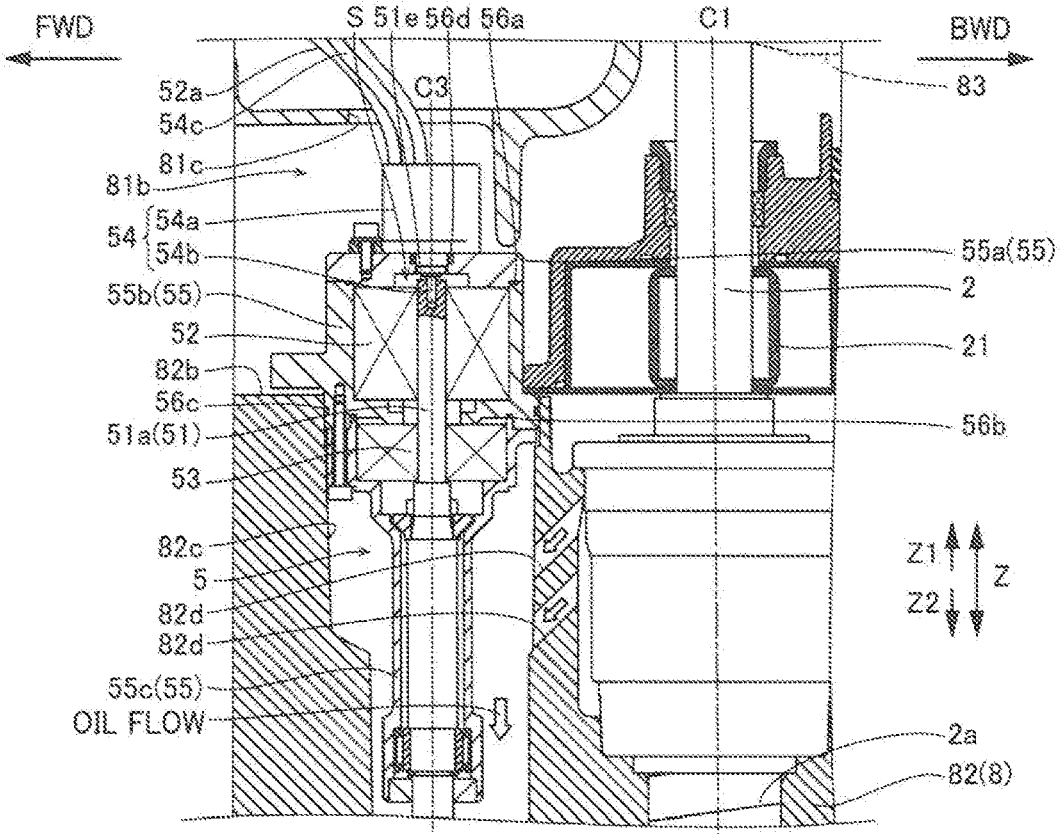
FIG. 6 is an enlarged sectional view showing the periphery of a motor of a shift switch of an outboard motor according to a preferred embodiment of the present invention.

According to a preferred embodiment of the present invention, as shown in FIG. 6, the motor 52 is provided on the axis C3 of the shift shaft 51 that extends in the upward-downward direction. Specifically, an upper portion of the shift shaft 51 passes through both the motor 52 and the speed reducer 53 disposed below the motor 52 in the upward-downward direction such that the motor 52 is provided on the axis C3 of the shift shaft 51 that extends in the upward-downward direction. The shift switch 5 switches the rotational drive force of the motor 52 about the axis C3 to the rotational drive force of the shift shaft 51 about the axis C3 via the speed reducer 53.

According to a preferred embodiment of the present invention, the entire motor 52 is disposed in the front space 81*b* below the pair of mounts 83 and the steering shaft 93. That is, the upper end of the motor 52 is disposed below the lower ends of the pair of mounts 83 and the lower end of the steering shaft 93. The motor 52, excluding a portion of a lower portion thereof, is disposed above the upper end 82*b* of the lower case 82. The motor 52 straddles the upper end 82*b* of the lower case 82 in the upward-downward direction such that the motor 52 is disposed adjacent to or in the vicinity of the upper end 82*b* of the lower case 82.

The shift switch 5 further includes a cover 55 such that the motor 52 and the speed reducer 53 are housed in a housing space S. The cover 55 includes a first cover 55*a*, a second cover 55*b*, and a third cover 55*c*. The first cover 55*a* contacts the upper surface of the motor 52 and covers an upper portion of the motor 52. The second cover 55*b* contacts the side surface and the lower surface of the motor 52 and covers the motor 52 from below. The third cover 55*c* covers the side surface of the speed reducer 53 and extends downward. The first cover 55*a*, the second cover 55*b*, and the third cover 55*c* are disposed in this order from the upper side to the lower side. The housing space S in which the motor 52 and the speed reducer 53 are housed is defined by the first cover 55*a* and the second cover 55*b*.

The first cover 55*a* is disposed in the front space 81*b* below the pair of mounts 83 and the steering shaft 93. The second cover 55*b* straddles the upper end 82*b* of the lower case 82, and the second cover 55*b*, excluding a lower portion thereof, is disposed in the front space 81*b* above the upper end 82*b* of the lower case 82. Thus, the entire motor 52 disposed in the housing space S is disposed below the pair of mounts 83 and the steering shaft 93.

A seal 56*a* is disposed at a contact portion between the lower end of the first cover 55*a* and the upper end of the second cover 55*b*. The seal 56*a* significantly reduces or prevents entry of water in the upper case 81 into the housing space S. A seal 56*b* is disposed at a contact portion between the lower end of the second cover 55*b* and the upper end of the third cover 55*c*. The seal 56*b* significantly reduces or prevents entry of oil in an oil chamber 82*c* of the lower case 82 into the housing space S. A seal 56*c* is disposed at a contact portion between the side surface of the second cover 55*b* and the inner wall of the lower case 82. The seal 56*c* significantly reduces or prevents entry of the oil in the oil chamber 82*c* of the lower case 82 into the upper case 81.

As shown in FIG. 2, the shift shaft 51 and the motor 52 are disposed on the side of the drive shaft 2 opposite to the propeller 6. That is, the shift shaft 51 and the motor 52 are disposed in front of the drive shaft 2.

As shown in FIG. 6, the speed reducer 53 transmits rotation of the motor 52 about the axis C3 to the shift shaft 51 so as to rotate the shift shaft 51 about the axis C3 while decelerating rotation of the motor 52.

According to a preferred embodiment of the present invention, the SPS 54 is provided on the axis C3 of the shift shaft 51 that extends in the upward-downward direction similarly to the motor 52. The SPS 54 includes an SPS main body 54*a* provided on the axis C3 and above the upper end 51*e* of the shift shaft 51, and a rotation detected element 54*b* fixed to the upper end 51*e* of the shift shaft 51 and that extends downward from the SPS main body 54*a*. The SPS main body 54*a* of the SPS 54 detects rotation of the shift shaft 51 by detecting the rotation angle of the rotation detected element 54*b* that rotates about the axis C3 together with the shift shaft 51.

The entire SPS 54 is disposed in the front space 81*b* below the pair of mounts 83 and the steering shaft 93. That is, the upper end of the SPS 54 is located below the lower ends of the pair of mounts 83 and the lower end of the steering shaft 93. In addition, the entire SPS 54 is disposed above the upper end 82*b* of the lower case 82. That is, the lower end of the SPS 54 is located above the upper end 82*b* of the lower case 82.

The SPS main body 54*a* of the SPS 54 is fixed to the upper surface of the first cover 55*a* that covers the upper portion of the motor 52. Consequently, the entire SPS 54 is located above the motor 52. A seal 56*d* is disposed at a contact portion between a portion of the SPS main body 54*a* that extends downward and an opening of the first cover 55*a*. The seal 56*d* significantly reduces or prevents entry of the water in the upper case 81 into the housing space S.

The motor 52 and the SPS 54 (cover 55) are disposed adjacent to or in the vicinity of the water pump 21. The motor 52 and the SPS 54 (cover 55) are located in front of the water pump 21 and at the same or substantially the same height as that of the motor 52 in the upward-downward direction. The motor 52 and the water pump 21 are disposed side by side in the forward-rearward direction of the vessel body 101 in a state in which the outboard motor 100 is attached to the vessel body 101.

Here, water supplied to the water pump 21 is located in the front space 81*b* of the upper case 81 around the cover portion 55 such that the motor 52 and the SPS 54 are indirectly cooled via the cover 55. Furthermore, as shown in FIG. 1, the motor 52 and the SPS 54 are located below the water surface during traveling such that the motor 52 and the SPS 54 are cooled via the lower case 82 and the cover 55 even by external water during traveling.

As shown in FIG. 6, a wiring hole 81*c* is provided just above the motor 52 and the SPS 54 in the front space 81*b* of the upper case 81. Motor wiring 52*a* extending from the upper portion of the motor 52 and SPS wiring 54*c* extending from an upper portion of the SPS 54 pass through the wiring hole 81*c*. Thus, the motor 52 is controlled by the ECU (not shown) of the engine 1 based on the rotational state of the shift shaft 51 detected by the SPS 54.

Figure 7:
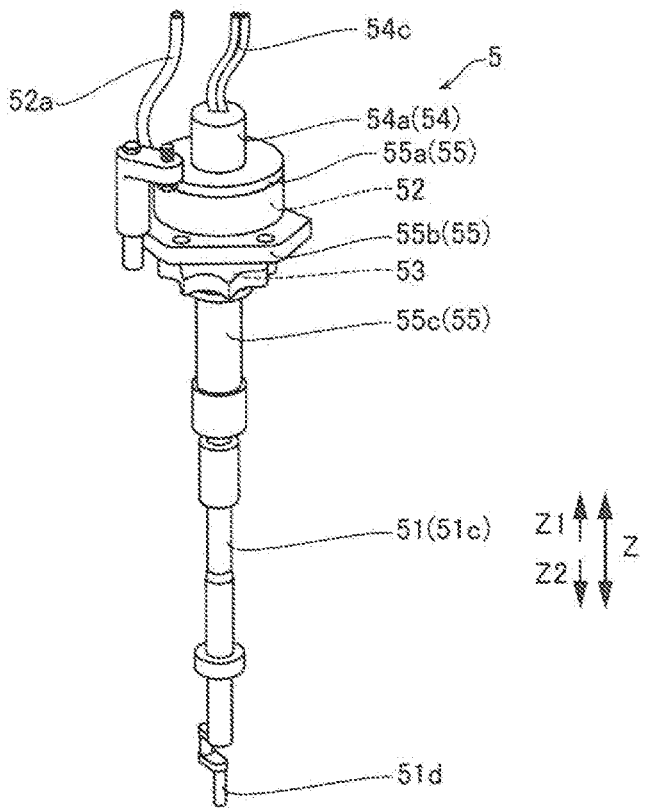
FIG. 7 is a perspective view showing a shift switch of an outboard motor according to a preferred embodiment of the present invention.

As shown in FIG. 7, the shift shaft 51, the motor 52, the speed reducer 53, the SPS 54, and the cover 55 of the shift switch 5 are fixed so as to be integral with each other. Consequently, the entire shift switch 5 including the shift shaft 51 and the motor 52 is integrally detachable.

As shown in FIGS. 4 and 5, the lower case 82 includes the oil chamber 82*c* in which oil is located (stored). The oil chamber 82*c* extends in the upward-downward direction from a location adjacent to or in the vicinity of the upper end 82*b* of the lower case 82 to the propeller shaft 3 disposed in the lower portion. The upper end of the oil chamber 82*c* is covered by the second cover 55*b*. The shift shaft 51 that extends in the upward-downward direction is disposed in the oil chamber 82*c*.

The gear 4, the drive shaft 2, the propeller shaft 3, etc. are lubricated with the oil. In addition, the oil absorbs the heat of the gear 4, the drive shaft 2, the propeller shaft 3, etc. such that the gear 4, the drive shaft 2, the propeller shaft 3, etc. are cooled. The oil is drawn from the gear 4 through the oil groove 2*a* of the drive shaft 2, passes through oil passages 82*d* (see FIG. 6) of the lower case 82, and flows into the oil chamber 82*c*. The oil cooled by the water outside the outboard motor 100 in the oil chamber 82*c* moves downward and flows again into the gear 4. In FIGS. 2 to 6, the oil flow is indicated by outlined arrows.

Here, the SPS 54 is disposed above the upper end 82*b* of the lower case 82 such that the SPS 54 is sufficiently spaced apart from the oil chamber 82*c*. The motor 52, excluding the portion of the lower portion thereof, is also disposed above the upper end 82*b* of the lower case 82 such that the motor 52 is spaced apart from the oil chamber 82*c*. Consequently, transmission of the heat of the oil to the SPS 54 and the motor 52 is significantly reduced or prevented. Furthermore, the upper portion of the motor 52 and the entire SPS 54 are not disposed below the upper end 82*b* of the lower case 82 such that the oil chamber 82*c* is sufficiently preserved in the lower case 82. Thus, even when the oil thermally expands, the volume of the oil chamber 82*c* is sufficiently preserved such that leakage of the oil to the outside of the outboard motor 100, for example, is significantly reduced or prevented.

According to the various preferred embodiments of the present invention described above, the following advantageous effects are achieved.

According to a preferred embodiment of the present invention, the motor 52 is provided on the axis C3 of the shift shaft 51. Accordingly, the drive force is directly transmitted from the motor 52 to the shift shaft 51 in order to rotate the shift shaft 51, and thus it is not necessary to provide an axis at a position different from that of the motor 52. Consequently, it is not necessary to provide a different axis, and thus an increase in the number of components of the shift switch 5 that switches the rotation direction of the propeller shaft 3 and an increase in the size of the shift switch 5 are significantly reduced or prevented. Therefore, increases in the weight and size of the outboard motor 100 including the shift switch 5 due to an increase in the number of components of the shift switch 5 are significantly reduced or prevented, and thus an increase in resistance generated during traveling of the marine vessel 102 including steering resistance is significantly reduced or prevented.

According to a preferred embodiment of the present invention, the entire motor 52 is disposed below the mounts 83 attached to the upper case 81. Accordingly, as compared with the case in which at least a portion of the motor 52 is disposed above the mounts 83, it is not necessary to extend the shift shaft 51 to the heights of the mounts 83 in the upward-downward direction, and thus an increase in the size of the shift switch 5 is further significantly reduced or prevented.

According to a preferred embodiment of the present invention, at least a portion of the motor 52 is disposed above the lower case 82 such that an increase in the size of the lower case 82 is significantly reduced or prevented, and thus an increase in resistance generated during traveling of the marine vessel 102 is significantly reduced or prevented.

According to a preferred embodiment of the present invention, the shift switch 5 switches the rotational drive force of the motor 52 about the axis C3 to the rotational drive force of the shift shaft 51 about the axis C3 via the speed reducer 53. Accordingly, as compared with the case in which a mechanism that switches movement of the shift shaft in the upward-downward direction to movement of the propeller shaft in the forward-rearward direction of the slider is used, a complicated structure of the shift switch 5 is significantly reduced or prevented.

According to a preferred embodiment of the present invention, the motor 52 is disposed adjacent to or in the vicinity of the upper end 82*b* of the lower case 82. Accordingly, the shift shaft 51 is disposed adjacent to or in the vicinity of the upper end 82*b* of the lower case 82, and increases in the sizes of the shift switch 5 and the outboard motor 100 are further significantly reduced or prevented.

According to a preferred embodiment of the present invention, the entire motor 52 is disposed below the steering shaft 93 that extends in the upward-downward direction. Accordingly, as compared with the case in which at least a portion of the motor 52 is disposed above the steering shaft 93, it is not necessary to extend the shift shaft 51 to the height of the steering shaft 93 in the upward-downward direction, and thus an increase in the size of the shift switch 5 is further significantly reduced or prevented. Furthermore, the motor 52 is disposed directly below the steering shaft 93, and thus as compared with the case in which the steering shaft 93 and the motor 52 are displaced from each other in the horizontal plane perpendicular to the upward-downward direction, an increase in the size of the outboard motor 100 in the horizontal direction is significantly reduced or prevented. Thus, an increase in resistance generated during traveling of the marine vessel 102 due to an increase in the size of the outboard motor 100 in the horizontal direction is significantly reduced or prevented.

According to a preferred embodiment of the present invention, the shift switch 5 is provided on the axis C3 of the shift shaft 51, and includes the SPS 54 that detects rotation of the shift shaft 51. Accordingly, the SPS 54 is disposed on the axis C3 of the shift shaft 51 that extends in the upward-downward direction, and thus as compared with the case in which the shift shaft 51 and the SPS 54 are displaced from each other in the horizontal plane perpendicular to the upward-downward direction, an increase in the size of the shift switch 5 in the horizontal direction is significantly reduced or prevented. Consequently, an increase in resistance generated during traveling of the marine vessel 102 due to an increase in the size of the outboard motor 100 in the horizontal direction is significantly reduced or prevented. Furthermore, rotation of the shift shaft 51 is detected by the SPS 54 such that the rotation direction (shift state) of the propeller shaft 3 is determined.

According to a preferred embodiment of the present invention, the entire SPS 54 is disposed below the mounts 83 and above the lower case 82. Accordingly, the SPS 54 is easily disposed adjacent to or in the vicinity of the motor 52 and the shift shaft 51, and thus the SPS 54 is reliably rotated by the shift shaft 51. Furthermore, the entire SPS 54 is not provided in the lower case 82 such that an increase in the size of the lower case 82 is significantly reduced or prevented.

According to a preferred embodiment of the present invention, the entire SPS 54 is disposed below the mounts 83. Accordingly, as compared with the case in which at least a portion of the SPS 54 is disposed above the mounts 83, it is not necessary to extend the shift shaft 51 to the heights of the mounts 83 in the upward-downward direction in order for the SPS 54 to detect the rotation, and thus an increase in the size of the shift switch 5 is further significantly reduced or prevented. Furthermore, the entire SPS 54 is disposed above the lower case. Accordingly, an increase in the size of the lower case 82 is significantly reduced or prevented, and thus an increase in resistance generated during traveling of the marine vessel 102 is significantly reduced or prevented.

According to a preferred embodiment of the present invention, the SPS 54 is attached to the upper surface of the first cover 55*a* that covers the upper portion of the motor 52. Accordingly, the SPS 54 is easily fixed above the motor 52 and adjacent to or in the vicinity of the motor 52.

According to a preferred embodiment of the present invention, the SPS 54 includes the rotation detected element 54*b* fixed to the shift shaft 51 and that rotates together with the shift shaft 51. Accordingly, rotation of the shift shaft 51 is directly detected, and thus rotation of the shift shaft 51 is more accurately detected.

According to a preferred embodiment of the present invention, the entire SPS 54 is disposed below the steering shaft 93. Accordingly, as compared with the case in which at least a portion of the SPS 54 is disposed above the steering shaft 93, an increase in the size of the shift switch 5 is further significantly reduced or prevented. In addition, the SPS 54 is disposed directly below the steering shaft 93, and thus as compared with the case in which the steering shaft 93 and the SPS 54 are displaced from each other in the horizontal plane perpendicular to the upward-downward direction, an increase in the size of the outboard motor 100 in the horizontal direction is significantly reduced or prevented.

According to a preferred embodiment of the present invention, the entire SPS 54 is disposed above the oil chamber 82*c*. Accordingly, an increase in the temperature of the SPS 54 due to the heat of the oil in the oil chamber 82*c* transmitted to the SPS 54 is significantly reduced or prevented. Furthermore, the SPS 54 and the oil chamber 82*c* are not located at the same height in the upward-downward direction, and thus it is not necessary to increase the size of the lower case 82 in order to preserve the volume of an air pocket in the oil chamber 82*c*. Furthermore, a decrease in the volume of the oil chamber 82*c* is significantly reduced or prevented.

According to a preferred embodiment of the present invention, the motor 52 and the shift shaft 51 are integrally detachable. Accordingly, the process to detach the motor 52 and the shift shaft 51 from the outboard motor 100 is simplified, and thus the motor 52 and the shift shaft 51 are easily replaced, for example.

According to a preferred embodiment of the present invention, the entire motor 52 is disposed below the mounts 83 located below the center of the upper case 81 in the upward-downward direction such that an increase in the size of the shift switch 5 is more reliably significantly reduced or prevented.

According to a preferred embodiment of the present invention, the motor 52 is disposed adjacent to or in the vicinity of the water pump 21 disposed above the lower case 82. Accordingly, a portion of the water that flows from the water pump 21 to the engine 1 is supplied to the periphery of the motor 52, and thus the motor 52 is cooled with the water. Consequently, an increase in the temperature of the motor 52 is significantly reduced or prevented.

According to a preferred embodiment of the present invention, the motor 52 and the water pump 21 are disposed side by side in the forward-rearward direction of the vessel body 101 in a state in which the outboard motor 100 is attached to the vessel body 101. Accordingly, as compared with the case in which the motor and the water pump are displaced from each other in a direction different from the forward-rearward direction in the horizontal plane, an increase in the size of the outboard motor 100 in a direction perpendicular to the forward-rearward direction in the horizontal plane is significantly reduced or prevented. Consequently, an increase in the size of the outboard motor 100 in a direction perpendicular to the traveling direction of the vessel body 101 to which the outboard motor 100 is attached is significantly reduced or prevented, and thus an increase in resistance generated during traveling of the marine vessel 102 is significantly reduced or prevented.

According to a preferred embodiment of the present invention, the first cover 55*a* that covers the upper portion of the motor 52 and the second cover 55*b* disposed at the upper end 82*b* of the lower case 82 so as to correspond to the first cover 55*a* and that covers the motor 52 from below are provided in the outboard engine 100. Furthermore, the motor 52 is disposed in the housing space S defined by the first cover 55*a* and the second cover 55*b*. Accordingly, at least a portion of the motor 52 is easily disposed above the lower case 82 while the motor 52 is protected by the first cover 55*a* and the second cover 55*b*. Furthermore, as compared with the case in which the first cover 55*a* and the second cover 55*b* are integral and unitary with each other, the motor 52 is more easily disposed in the housing space S.

According to a preferred embodiment of the present invention, at least the portion of the motor 52 is located above the oil chamber 82*c*. Accordingly, at least the portion (lower portion) of the motor 52 and the oil chamber 82*c* are not located at the same height in the upward-downward direction such that it is not necessary to increase the size of the oil chamber 82*c*, and a decrease in the volume of the oil chamber 82*c* is significantly reduced or prevented.

According to a preferred embodiment of the present invention, the motor 52 straddles the upper end 82*b* of the lower case 82 in the upward-downward direction. Accordingly, a portion of the motor 52 is disposed above the lower case 82 such that an increase in the size of the lower case 82 is significantly reduced or prevented. Furthermore, a portion of the motor 52 is disposed below the lower case 82 such that interference between a member (such as the steering shaft 93 (bracket 9)) disposed above the motor 52 and the shift switch 5 due to the motor 52 being disposed on the upper side is significantly reduced or prevented.

According to a preferred embodiment of the present invention, the motor 52 is electrically operated. Accordingly, unlike the case in which the shift shaft 51 is rotated using a mechanical motor to which a drive force is mechanically transmitted from the engine 1, the motor 52 is driven based on an electric signal, and thus the rotation direction of the propeller shaft 3 is easily changed through the shift shaft 51 by the ECU that transmits an electric signal.

According to a preferred embodiment of the present invention, the motor wiring 52*a* extends from the upper portion of the electric motor 52. Accordingly, the ECU, which is likely to be disposed in an upper portion of the outboard motor 100 in order to be protected from water, and the electric motor 52 are easily electrically connected to each other.

According to a preferred embodiment of the present invention, the upper end 51*e* of the shift shaft 51 is disposed above the upper end 82*b* of the lower case 82. Accordingly, the shift shaft 51 is reliably connected to even the portion of the motor 52 disposed above the upper end 82*b* of the lower case 82.

According to a preferred embodiment of the present invention, the shift shaft 51 and the motor 52 are disposed on the side of the drive shaft 2 opposite to the propeller 6. Accordingly, the shift shaft 51 is smaller than the drive shaft 2, and thus an increase in the size of a portion of the lower case 82 on the side opposite to the propeller 6 in the horizontal direction is significantly reduced or prevented as compared with the case in which the shift shaft is disposed between the drive shaft 2 and the propeller 6. Consequently, an increase in resistance (wave-making resistance) generated in the marine vessel 102 to which the outboard motor 100 is attached during traveling is significantly reduced or prevented.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the shift switch is preferably applied to the outboard motor 100 in preferred embodiments of the present invention described above, the present invention is not restricted to this. That is, the shift switch may alternatively be applied to a motor other than an outboard motor. For example, the shift switch may be applied to a marine vessel including an inboard motor or an inboard/outboard motor.

While the motor 52 (rotary drive) excluding the portion of the lower portion of the motor 52 is preferably disposed above the upper end 82*b* of the lower case 82 in preferred embodiments described above, the present invention is not restricted to this. The entire rotary drive may alternatively be disposed above the upper end of the lower case. Thus, a decrease in the volume of the oil chamber is further significantly reduced or prevented.

While the SPS 54 (rotation sensor) is preferably disposed on the axis C3 of the shift shaft 51 in preferred embodiments described above, the present invention is not restricted to this. The rotation sensor may alternatively be disposed at a position different from the axis of the shift shaft.

While the entire SPS 54 (rotation sensor) is preferably disposed below the mounts 83 and above the lower case 82 in preferred embodiments described above, the present invention is not restricted to this. For example, the rotation sensor may alternatively be disposed below the lower case or at the same or substantially the same height as that of the lower case in the upward-downward direction.

While the entire SPS 54 (rotation sensor) is preferably disposed above the motor 52 (rotary drive) in preferred embodiments described above, the present invention is not restricted to this. The rotation sensor may alternatively be disposed below the rotary drive or at the same or substantially the same height as that of the rotary drive in the upward-downward direction.

While the motor 52 is preferably disposed above the speed reducer 53 in preferred embodiments described above, the present invention is not restricted to this. The rotary drive may alternatively be disposed below the speed reducer. Furthermore, the rotational drive force of the rotary drive may alternatively be directly transmitted to the shift shaft without providing the speed reducer.

While the shift shaft 51 preferably includes the upper portion 51*a*, the lower portion 51*b*, and the connector 51*c* in preferred embodiments described above, the present invention is not restricted to this. The shift shaft 51 may not be divided in the upward-downward but may include a single member.

Figure 8:
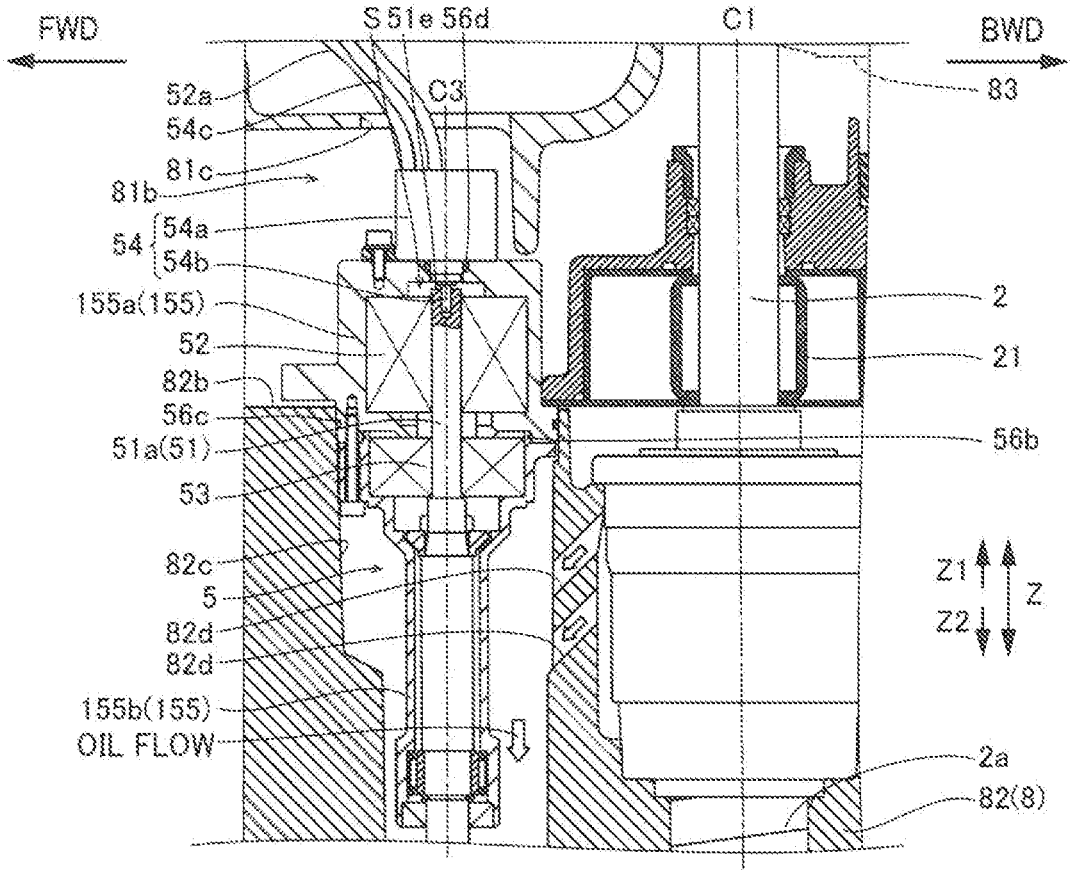
FIG. 8 is an enlarged sectional view showing the periphery of a motor of a shift switch according to a modified preferred embodiment of the present invention.

While the housing space S in which the motor 52 and the speed reducer 53 are housed is preferably defined by the first cover 55*a* and the second cover 55*b* in preferred embodiments described above, the present invention is not restricted to this. The housing space S may alternatively be defined by one or three or more covers. For example, in a modified preferred embodiment shown in FIG. 8, a housing space S in which at least a motor 52 is housed may be defined by a single first cover 155*a*. The first cover 155*a* includes a shape in which the first cover 55*a* and the second cover 55*b* (see FIG. 7) according to preferred embodiments described above are integral and unitary with each other. Thus, at least a portion of the motor 52 is easily disposed above a lower case 82 while the motor 52 is protected by the first cover 155*a*. Furthermore, unlike the case in which the first cover 155*a* includes a plurality of covers, an increase in the number of components is significantly reduced or prevented. Note that a second cover 155*b* has the same shape as that of the third cover 55*c* according to preferred embodiments described above. In addition, in the modified preferred embodiment shown in FIG. 8, the first cover 55*a* and the second cover 55*b* are integral and unitary with each other such that it is not necessary to provide a seal 56*a* (see FIG. 7), and thus also from this point of view, an increase in the number of components is significantly reduced or prevented.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

a propeller;

a propeller shaft that transmits a drive force from the engine to the propeller;

a mount that dampens a vibration of the engine transmitted to a vessel body;

an upper case to which the mount is attached;

a lower case disposed below the upper case and in which the propeller shaft is disposed; and a shift switch including a shift shaft that extends in an upward-downward direction and rotates to move the propeller shaft in a direction in which the propeller shaft extends and a rotary drive provided on a central axis line of the shift shaft and that rotates the shift shaft, and that switches a rotation direction of the propeller shaft; wherein an entirety of the rotary drive is disposed below the mount; and at least a portion of the rotary drive is disposed above the lower case.

2. The outboard motor according to claim 1, wherein the rotary drive is disposed adjacent to or in a vicinity of an upper end of the lower case.

3. The outboard motor according to claim 1, further comprising:

a steering shaft that extends in the upward-downward direction and allows the outboard motor to turn; wherein the entirety of the rotary drive is disposed below the steering shaft.

4. The outboard motor according to claim 1, wherein the shift switch further includes a rotation sensor provided on the central axis line of the shift shaft and that detects rotation of the shift shaft.

5. The outboard motor according to claim 4, wherein an entirety of the rotation sensor is disposed below the mount and above the lower case.

6. The outboard motor according to claim 4, wherein an entirety of the rotation sensor is disposed below the mount and above the rotary drive.

7. The outboard motor according to claim 6, further comprising:

a first cover that covers an upper portion of the rotary drive; wherein the rotation sensor is attached to an upper surface of the first cover.

8. The outboard motor according to claim 4, wherein the rotation sensor includes a rotation detected element fixed to the shift shaft and that rotates together with the shift shaft.

9. The outboard motor according to claim 4, further comprising:

a steering shaft that extends in the upward-downward direction and allows the outboard motor to turn; wherein an entirety of the rotation sensor is disposed below the steering shaft.

10. The outboard motor according to claim 4, wherein the lower case includes an oil chamber that extends in the upward-downward direction and in which the shift shaft and oil are located; and an entirety of the rotation sensor is located above the oil chamber.

11. The outboard motor according to claim 1, wherein the rotary drive and the shift shaft are integrally detachable.

12. The outboard motor according to claim 1, further comprising:

a water pump disposed above the lower case and that supplies external water to the engine; wherein the rotary drive is disposed adjacent to or in a vicinity of the water pump.

13. The outboard motor according to claim 12, wherein the rotary drive and the water pump are disposed side by side in a forward-rearward direction of the vessel body in a state in which the outboard motor is attached to the vessel body.

14. The outboard motor according to claim 1, further comprising:

a first cover that covers an upper portion of the rotary drive; and a second cover disposed at an upper end of the lower case to correspond to the first cover and to cover the rotary drive from below; wherein the rotary drive is disposed in a space defined by the first cover and the second cover.

15. The outboard motor according to claim 1, further comprising:

a first cover that covers an upper portion of the rotary drive and covers the rotary drive from below; wherein the rotary drive is disposed in a space defined by the first cover.

16. The outboard motor according to claim 1, wherein the lower case includes an oil chamber that extends in the upward-downward direction and in which the shift shaft and oil are located; and at least a portion of the rotary drive is located above the oil chamber.

17. The outboard motor according to claim 1, wherein the rotary drive straddles an upper end of the lower case in the upward-downward direction.

18. The outboard motor according to claim 1, wherein the rotary drive includes an electric motor.

19. The outboard motor according to claim 18, further comprising wiring extending from an upper portion of the electric motor.

20. The outboard motor according to claim 1, wherein an upper end of the shift shaft is disposed above an upper end of the lower case.

21. The outboard motor according to claim 1, wherein the shift shaft and the rotary drive are disposed on a side of a drive shaft, which transmits a drive force from the engine to the propeller shaft, opposite to the propeller.

22. A shift switch of an outboard motor that switches a rotation direction of a propeller shaft that transmits a drive force from an engine to a propeller, the shift switch comprising:

a shift shaft that extends in an upward-downward direction and rotates to move the propeller shaft in a direction in which the propeller shaft extends; and a rotary drive provided on a central axis line of the shift shaft and that rotates the shift shaft; wherein an entirety of the rotary drive is disposed below a mount that dampens a vibration of the engine transmitted to a vessel body; and at least a portion of the rotary drive is disposed above a lower case in which the propeller shaft is disposed.

23. The shift switch of an outboard motor according to claim 22, wherein the rotary drive is disposed adjacent to or in a vicinity of an upper end of the lower case.

24. The shift switch of an outboard motor according to claim 22, further comprising a rotation sensor provided on the central axis line of the shift shaft and that detects rotation of the shift shaft.

25. The shift switch of an outboard motor according to claim 22, wherein the rotary drive is disposed adjacent to or in a vicinity of a water pump disposed above the lower case and that supplies external water to the engine due to a drive force of a drive shaft that transmits a drive force from the engine to the propeller shaft.

* * * * *